US009761999B2

(12) United States Patent
Akino

(10) Patent No.: US 9,761,999 B2
(45) Date of Patent: Sep. 12, 2017

(54) CONNECTOR FOR MICROPHONE AND MICROPHONE

(71) Applicant: Hiroshi Akino, Kanagawa (JP)

(72) Inventor: Hiroshi Akino, Kanagawa (JP)

(73) Assignee: KABUSHIKI KAISHA AUDIO-TECHNICA, Tokyo (JP)

( * ) Notice: Subject to any disclaimer, the term of this patent is extended or adjusted under 35 U.S.C. 154(b) by 0 days.

(21) Appl. No.: 15/097,368

(22) Filed: Apr. 13, 2016

(65) Prior Publication Data

US 2016/0308305 A1 Oct. 20, 2016

(30) Foreign Application Priority Data

Apr. 15, 2015 (JP) ..... 2015-083105

(51) Int. Cl.

| | |
|---|---|
| ***H04R 9/08*** | (2006.01) |
| ***H01R 13/633*** | (2006.01) |
| ***H04R 1/04*** | (2006.01) |
| ***H01R 13/627*** | (2006.01) |
| ***H01R 24/28*** | (2011.01) |
| *H01R 103/00* | (2006.01) |

(52) U.S. Cl.

CPC ..... *H01R 13/6335* (2013.01); *H01R 13/6273* (2013.01); *H01R 24/28* (2013.01); *H04R 1/04* (2013.01); *H01R 2103/00* (2013.01); *H04R 2410/03* (2013.01); *H04R 2420/09* (2013.01)

(58) Field of Classification Search

CPC ..... H04R 1/04; H04R 1/08; H01R 13/6271
USPC ..... 381/363, 364
See application file for complete search history.

(56) References Cited

FOREIGN PATENT DOCUMENTS

| | | | |
|---|---|---|---|
| JP | 6068781 B | * | 5/1985 |
| JP | 4686410 B2 | | 5/2011 |

* cited by examiner

*Primary Examiner* — Sunita Joshi
(74) *Attorney, Agent, or Firm* — Whitham, Curtis & Cook, P.C.

(57) ABSTRACT

A connector for a microphone and a microphone are provided that can prevent loose connections to a microphone stand. The connector for the microphone is to be inserted into a connector support hole of a microphone stand. The connector includes pins to be electrically connected to the microphone stand, a connector body accommodating the pins, a sleeve disposed on the outer circumferential surface of the connector body, and an elastic member for biasing the sleeve toward the rear end of the connector body. The sleeve has an insertion portion to be inserted into a space between the connector body and the connector support hole.

7 Claims, 10 Drawing Sheets

CONNECTOR FOR MICROPHONE AND MICROPHONE

TECHNICAL FIELD

The present invention relates to a connector for a microphone and a microphone.

BACKGROUND ART

A gooseneck microphone includes a flexible pipe that serves as a support for a microphone unit. The microphone unit of the gooseneck microphone is directed to a sound source by bending the flexible pipe to a desired direction. The gooseneck microphone is used, for example, as a microphone for conferences.

FIG. 5 is an external view of a conventional gooseneck microphone. A gooseneck microphone 10 includes a microphone case 2, a microphone unit 2*a*, a rear case 3, a first flexible pipe 4, a pipe 5, a joint 6, a second flexible pipe 7, a connector case 8, and a connector.

The microphone unit 2*a* is accommodated in the front (the direction of the gooseneck microphone 10 to a sound source during sound collection,) portion of the microphone case 2. The microphone unit 2*a* generates audio signals corresponding to sound waves received from the sound source, and outputs the signals.

The first flexible pipe 4 is connected to the rear (right side in FIG. 5) portion of the microphone case 2 via the rear case 3. The first flexible pipe 4 is connected to one end of the pipe 5. The other end of the pipe 5 is connected to one end of the second flexible pipe 7 via the joint 6. The other end of the second flexible pipe 7 is connected to the connector.

FIG. 6 is a cross-sectional view of a connector portion of the gooseneck microphone 10. Illustration of the connector case 8 is not shown in FIG. 6. The connector includes the connector case 8 (see FIG. 5), a connector base 9, a connector body 90, a first pin 91 for ground, a second pin 92 for hot signals, and a third pin 93 for cold signals. The front end of the connector base 9 is connected to the second flexible pipe 7. The three pins 91, 92, and 93 are disposed at the rear end of the connector base 9. The connector base 9, and the three pins 91, 92, and 93 are accommodated in the connector body 90. The connector body 90 has a latch hole 94 that can be engaged with a latch claw described below. The latch hole 94 is formed on the inner circumferential surface in the rear end of the connector body 90.

Referring now back to FIG. 5, the outer surface of the connector body 90 is covered by the connector case 8. The connector case 8 includes a small diameter portion 81, a medium diameter portion 82, and a large diameter portion 83 in sequence from the side connected to the second flexible pipe 7 of the connector. The pipe 5 and the joint 6 are composed of metal. The pipe 5 and the joint 6 have shapes of straight tubes.

The microphone unit 2*a* is connected to the connector base 9 via a connection member that includes the microphone case 2, the rear case 3, the first flexible pipe 4, the pipe 5, the joint 6, and the second flexible pipe 7. The audio signals generated by the microphone unit 2*a* are output to the connector base 9 via a microphone cable (not shown) inserted into the connection member.

FIG. 7 is a perspective view of a microphone stand to which the gooseneck microphone 10 is to be attached.

A microphone stand 20 includes a base body 21, a latch release lever 23, a talk button 24, a light 25, and a first output connector 30 (see FIG. 8).

The base body 21 has a connector insertion hole 22 (see FIG. 8). The connector insertion hole 22 is formed on the upper surface of the base body 21. A first output connector 30 (see FIGS. 8 and 9) described below can be inserted into the connector insertion hole 22. The first output connector 30 is to be fixed to the connector insertion hole 22.

FIG. 8 is a partially sectional view of the first output connector 30.

The first output connector 30 includes a body, a first pin 31, a second pin 32, a third pin 33, a flange 34, a pin receiver 35, a latch claw 36, and connector support holes 37.

The flange 34 fixes the body of the first output connector 30 with screws on the base body 21. The flange 34 is disposed on the outer surface of the body of the first output connector 30. The pin receiver 35 is disposed in the center of the upper surface of the body of the first output connector 30. The connector support hole 37 is formed around the pin receiver 35. That is, the connector support hole 37 is formed on the upper surface of the first output connector 30. The flange 34, the pin receiver 35, and the connector support hole 37 protrude from the upper surface of the base body 21. The latch claw 36 is disposed on the outer surface of the pin receiver 35 in the connector support hole 37. The latch claw 36 can be engaged with the latch hole 94 (see FIG. 6). The diameter of the connector insertion hole 22 is larger than the outer diameter of the body of the first output connector 30, and smaller than the outer diameter of the flange 34.

The pins 91, 92, and 93 of the connector base 9 can be inserted into the pin receiver 35. When the pins 91, 92, and 93 of the connector base 9 are inserted into the pin receiver 35, then the first pin 91 is electrically connected to the first pin 31, the second pin 92 is electrically connected to the second pin 32, and the third pin 93 is electrically connected to the third pin 33.

FIG. 9 is a schematic view of example use of the gooseneck microphone 10 attached to the microphone stand 20.

The rear end of the connector case 8, in other words, the rear end of the connector body 90 is inserted into the connector support hole 37. The latch claw 36 of the first output connector 30 engages with the latch hole 94 of the connector body 90. The gooseneck microphone 10 is mechanically connected to the microphone stand 20, and attached in an upright state. By bending the first flexible pipe 4 and the second flexible pipe 7, the microphone unit 2*a* accommodated in the microphone case 2 directs toward a desired direction as shown by the arrow in FIG. 9, for example, to a direction toward the mouth of a speaker.

A second output connector 40 is disposed in the back side of the base body 21 (right side in FIG. 9). The shape of the second output connector 40 is similar to that of the first output connector 30. The first pins, the second pins, and the third pins of the first output connector 30 and the second output connector 40 are electrically connected with each other within the base body 21, for example, with a lead wire (not shown). A plug 50 is inserted into the second output connector 40. The plug 50 is connected to an external device such as a mixer (not shown) via a microphone cord 60.

When the connector base 9 is inserted into the connector support hole 37 of the first output connector 30, then the first pin 91 is electrically connected to the first pin 31, the second pin 92 is electrically connected to the second pin 32, and the third pin 93 is electrically connected to the third pins 33, as described above. As a result, the audio signals generated by the microphone unit 2*a* are output to the microphone cord 60 via the connector base 9, the first output connector 30, and the second output connector 40.

The talk button 24 (see FIG. 7) is used to control the output of the audio signals generated by the microphone unit 2*a* to the microphone cord 60. That is, the microphone stand 20 includes a control circuit for outputting the audio signals to the microphone cord 60 in response to the operation of the talk button 24. The control circuit outputs the audio signals to the microphone cord 60, for example, only during pressing of the talk button 24 with a finger of an operator. The light 25 (see FIG. 7) is turned on when the control circuit is capable of outputting the audio signals to the microphone cord 60.

When the latch release lever 23 is pressed, for example, with a finger of the operator, then the engagement between the latch claw 36 and the latch hole 94 is released. By the releasing operation, the gooseneck microphone 10 attached to the microphone stand 20 is detached from the microphone stand 20.

FIG. 10 is a partially sectional view of the connector case 8 of the gooseneck microphone 10 attached to the first output connector 30.

As shown in FIG. 10, a space is defined between the inner circumferential surface of the connector support hole 37 of the first output connector 30 and the outer circumferential surface of the large diameter portion 83 of the connector case 8. The gooseneck microphone 10 is attached to the microphone stand 20 only by the engagement of the latch claw 36 and the latch hole 94. Thus, the space between the connector support hole 37 and the connector case 8 causes loose connections of the gooseneck microphone 10 to the microphone stand 20. These loose connections can transmit, for example, vibration of a desk on which the microphone stand 20 is placed to the gooseneck microphone 10. The microphone unit 2*a* generates a noise signal due to the vibration, and outputs the signal.

Schemes have been proposed to prevent the loose connections of the gooseneck microphone to the microphone stand to reduce the output of the noise (for example, refer to Japanese Patent No. 4686410).

SUMMARY OF INVENTION

Technical Problem

An object of the present invention, which has been made to solve the problem described above, is to provide a connector for a microphone and the microphone that can prevent the loose connections to a microphone stand with a simple structure.

The connector for a microphone according to the present invention is to be inserted into a connector support hole of a microphone stand and includes pins to be electrically connected to the microphone stand; a connector body accommodating the pins; a sleeve provided on an outer surface of the connector body; and an elastic member for biasing the sleeve toward the rear end of the connector body, wherein the sleeve has an insertion portion to be inserted into a space between the connector body and the connector support hole.

According to the present invention, loose connections to a microphone stand can be prevented.

DESCRIPTION OF EMBODIMENTS

Embodiments of a connector for a microphone and a microphone will now be described with reference to the attached drawings. In the description below, a gooseneck microphone will be described as an example microphone according to the present invention.

Figure 1:
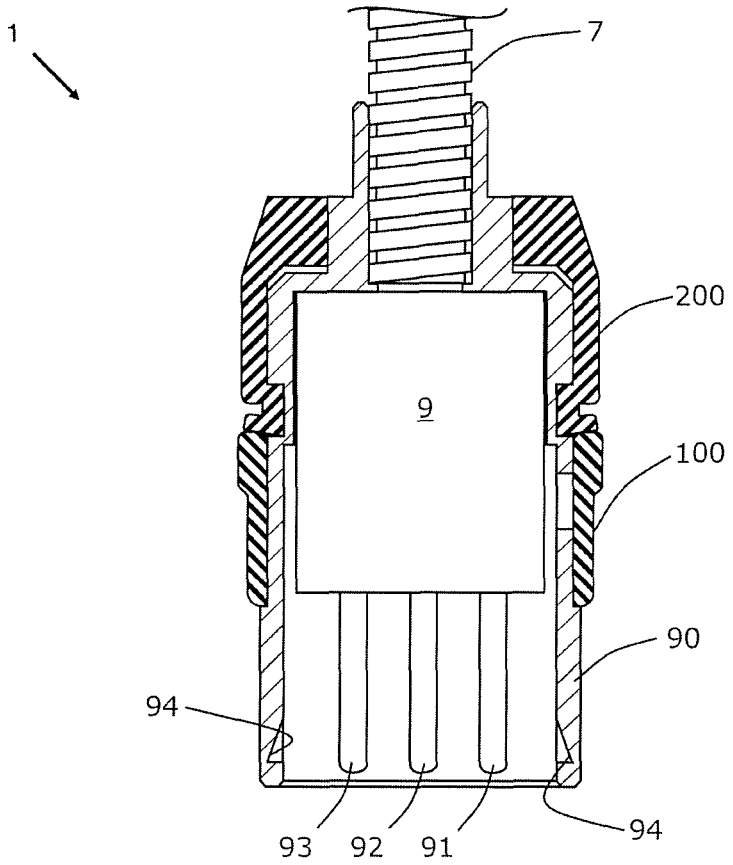
FIG. 1 is a cross-sectional view of a connector portion of a microphone according to the present invention.

FIG. 1 is a cross-sectional view of a connector portion of the gooseneck microphone according to the present invention.

Figure 5:
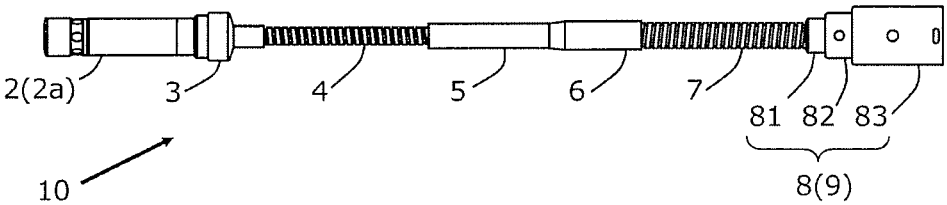
RELATED ART FIG. 5
FIG. 5 is an external view of a conventional gooseneck microphone.
Figure 6:
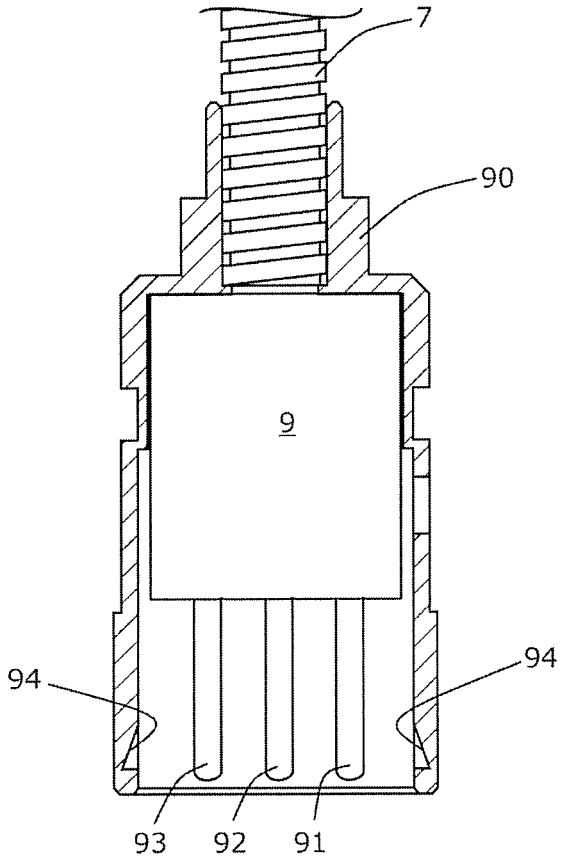
RELATED ART FIG. 6
FIG. 6 is a cross-sectional view of the connector portion of the conventional gooseneck microphone.

The structure of the gooseneck microphone 1 according to the present invention differs from that of the conventional gooseneck microphone 10 shown in FIG. 5 in the following points. The gooseneck microphone 1 according to the present invention is provided with a sleeve 100 and an elastic member 200 attached on an outer circumferential surface of a connector body 90 in place of the connector case 8 of the conventional gooseneck microphone 10.

A gooseneck microphone 1 according to the present invention includes a microphone case 2, a microphone unit 2*a*, a rear case 3, a first flexible pipe 4, a pipe 5, a joint 6, a second flexible pipe 7, and a connector for the microphone according to the present invention. The connector for the microphone according to the present invention includes a connector base 9, a connector body 90, a sleeve 100, and an elastic member 200.

Figure 7:
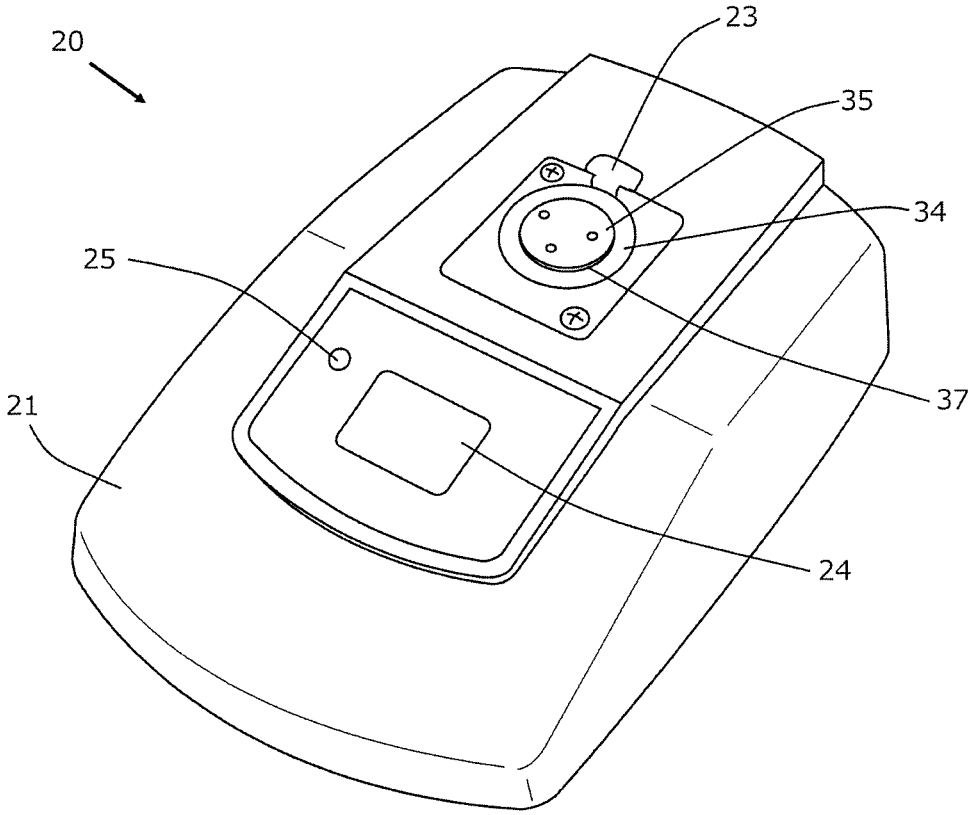
FIG. 7 is a perspective view of the microphone stand to which the conventional gooseneck microphone is to be attached.
Figure 8:
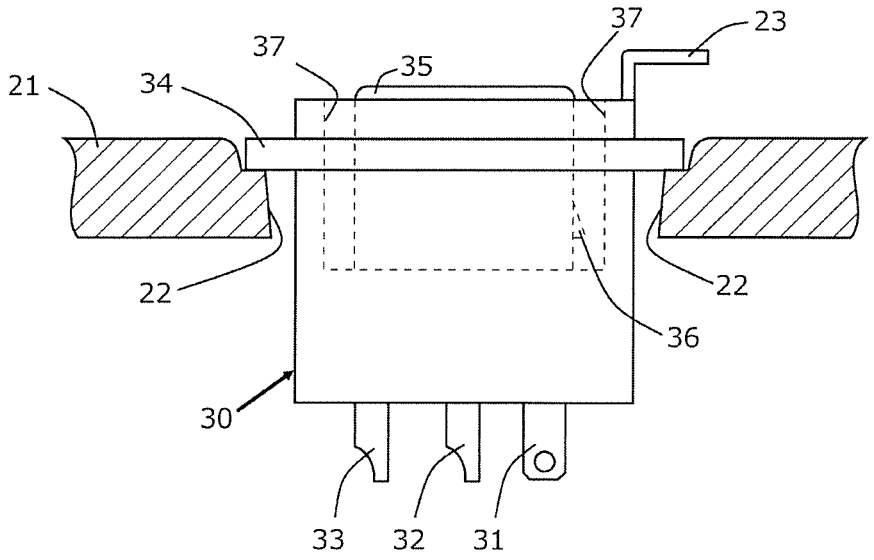
FIG. 8 is a partially sectional view of the first output connector of the microphone stand.

The gooseneck microphone 1 is attachable to the microphone stand 20 shown in FIG. 7 and is used similarly to the conventional gooseneck microphone 10. Hereinafter, the gooseneck microphone 1 according to the present invention will now be described also with reference to FIGS. 5 and 7.

The microphone unit 2*a* is accommodated in the front (the direction of the gooseneck microphone 1 to a sound source during sound collection) portion of the microphone case 2. The microphone unit 2*a* generates audio signals corresponding to sound waves received from the sound source, and outputs the signals.

The rear portion of the microphone case 2 is connected to the first flexible pipe 4 via the rear case 3. The first flexible pipe 4 is connected to one end of the pipe 5. The other end of the pipe 5 is connected to one end of the second flexible pipe 7 via the joint 6. The other end of the second flexible pipe 7 is connected to the connector base 9. The pipe 5 and the joint 6 are composed of metal. The pipe 5 and the joint 6 have shapes of straight tubes. The sleeve 100 and the elastic member 200 will be described below.

The microphone unit 2*a* is connected to the connector base 9 via a connection member that includes the microphone case 2, the rear case 3, the first flexible pipe 4, the pipe 5, the joint 6, and the second flexible pipe 7. That is, the connection member connects the microphone unit 2*a* with the connector. The audio signals generated by the microphone unit 2*a* are output to the connector (connector base 9) via a microphone cable inserted into the connection member.

The second flexible pipe 7 is connected to the front end (upper side in FIG. 1) of the connector base 9. The connector base 9 includes, for example, a first pin 91 for ground, a second pin 92 for hot signals, and a third pin 93 for cold signals at the rear end (lower side in FIG. 1) of the connector base 9, and conforms to JEITA Standard RC-5236 "Circular Connectors, Latch Lock Type for Audio Equipment". The connector base 9, and the three pins 91, 92, and 93 are accommodated in the connector body 90. These pins 91, 92, and 93 are electrically connected to the microphone stand 20.

The second flexible pipe 7 which consists the connection member is supported by the front portion of the connector body 90.

The connector body 90 has a latch hole 94. The latch hole 94 can be engaged with a latch claw 36. The latch hole 94 is formed on the inner circumferential surface of the rear end of the connector body 90. The latch hole 94 is formed at a position closer to the rear end of the connector body 90 than a position where the sleeve 100, which will be described below, is attached.

The gooseneck microphone 1 is attached to the microphone stand 20 shown in FIG. 7. That is, the rear end of the connector body 90 is inserted into a connector support hole 37. The latch claw 36 of the first output connector 30 engages with the latch hole 94 of the connector body 90. The gooseneck microphone 1 is mechanically connected to the microphone stand 20, and attached in an upright state. By bending the first flexible pipe 4 and the second flexible pipe 7, the microphone unit 2*a* accommodated in the microphone case 2 is directed toward a desired direction, for example, in a direction toward the mouth of a speaker.

The first output connector 30 includes a first pin 31, a second pin 32, and a third pin 33. These pins 91, 92, and 93 of the connector base 9 can be inserted into the pin receiver 35. When the pins 91, 92, and 93 of the connector base 9 are inserted into the pin receiver 35, then the first pin 91 is electrically connected to the first pin 31, the second pin 92 is electrically connected to the second pin 32, and the third pin 93 is electrically connected to the third pin 33.

Figure 9:
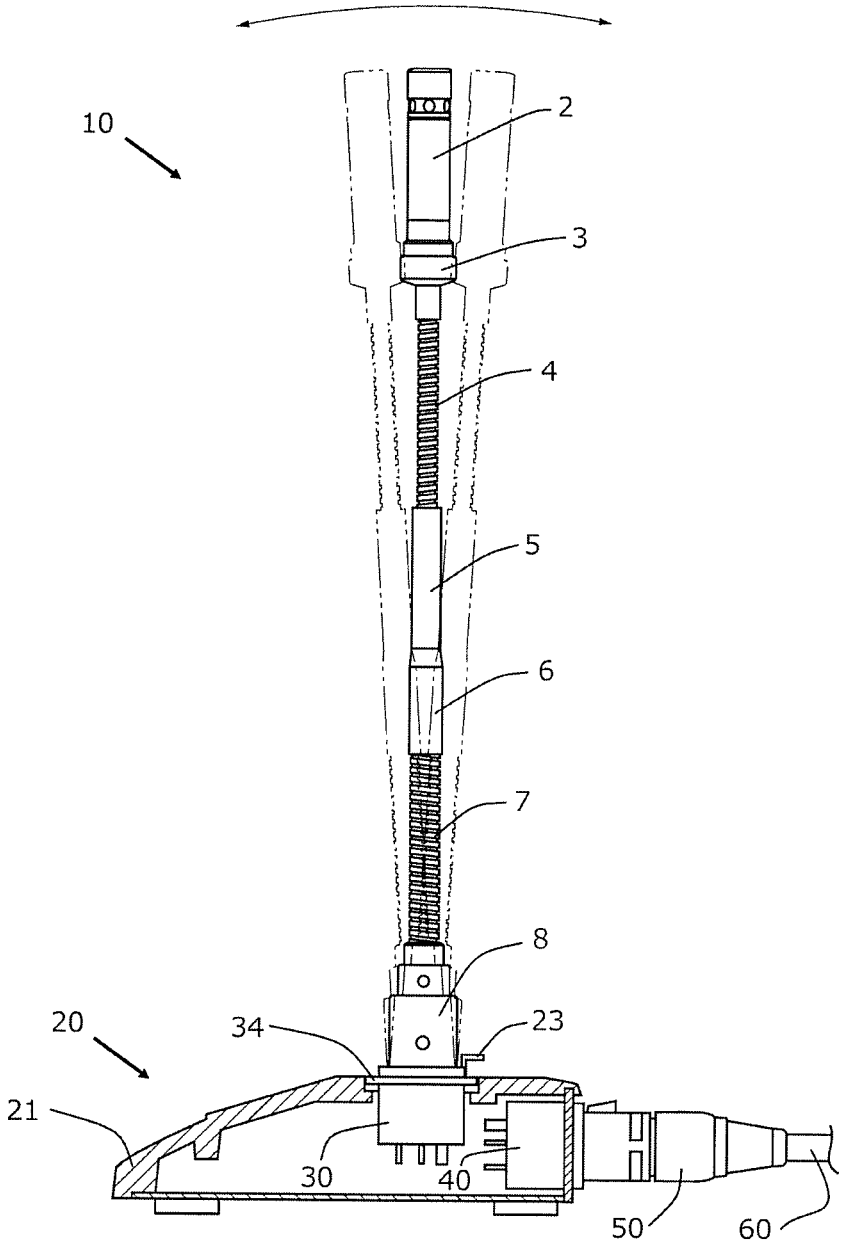
RELATED ART FIG. 9
FIG. 9 is a schematic view of example use of the conventional gooseneck microphone attached to the microphone stand.
Figure 10:
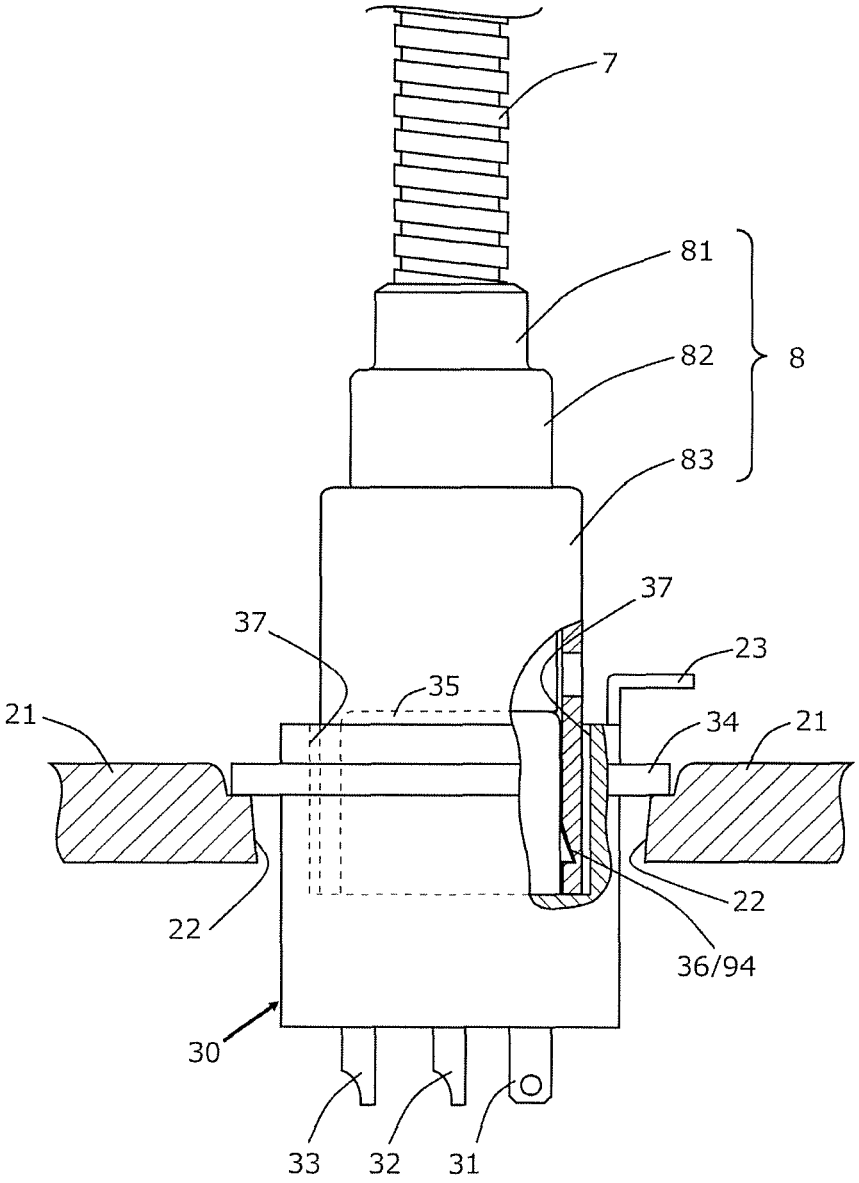
RELATED ART FIG. 10
FIG. 10 is a partially sectional view of the connector case portion of the conventional gooseneck microphone attached to the microphone stand.

A second output connector 40 is disposed in back side of the base body 21 (see FIG. 9). The shape of the second output connector 40 is similar to that of the first output connector 30. The first pins, the second pins, and the third pins of the first output connector 30 and the second output connector 40 are electrically connected with each other within the base body 21, for example, with a lead wire (not shown). A plug 50 is inserted into the second output connector 40. The plug 50 is connected to an external device such as a mixer (not shown) via a microphone cord 60.

When the rear end portion of the connector body 90 is inserted into the connector support hole 37 of the first output connector 30, then the first pin 91 is electrically connected to the first pin 31, the second pin 92 is electrically connected to the second pin 32, and the third pin 93 is electrically connected to the third pin 33, as described above. As a result, the audio signals generated by the microphone unit 2*a* are then output to the microphone cord 60 via the connector base 9, the first output connector 30, and the second output connector 40.

When the latch release lever 23 is pressed, for example, with a finger of the operator, then the engagement between the latch claw 36 and the latch hole 94 is released. By the releasing operation, the gooseneck microphone 1 attached to the microphone stand 20 is detached from the microphone stand 20.

Figure 2:
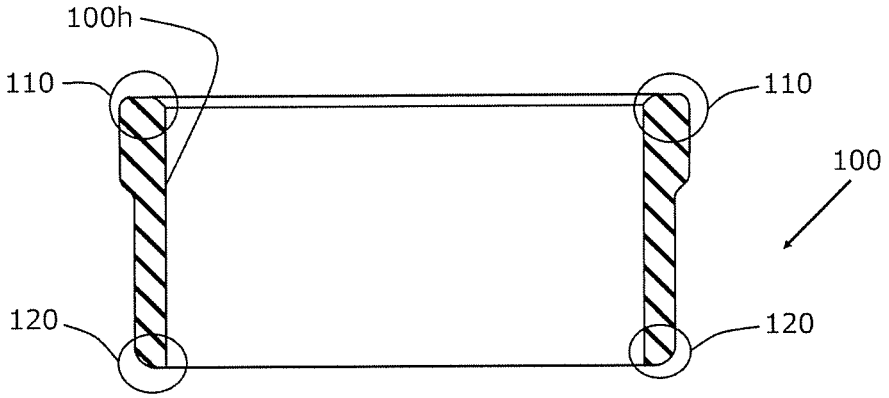
FIG. 2 is a cross-sectional view of a sleeve of the connector.

FIG. 2 is a cross-sectional view of the sleeve 100.

The sleeve 100 is composed of an elastic material. The sleeve 100 has a shape of a cylinder (a substantial cylinder). The sleeve 100 includes a connector body insertion hole 100*h*, a portion to be pressed 110, and an insertion portion 120. The inner circumferential surface of the sleeve 100 is the connector body insertion hole 100*h*. The connector body 90 is to be inserted into the connector body insertion hole 100*h* of the sleeve 100. The portion to be pressed 110 is disposed in the proximity of one open end (front end) of the sleeve 100. The portion to be pressed 110 is pressed from an elastic member 200 described below. The insertion portion 120 is disposed in the proximity of the other open end (rear end) of the sleeve 100. The insertion portion 120 is inserted into a space between the connector body 90 and the connector support hole 37.

The outer diameter of the insertion portion 120 gradually decreases from the front end (upper side in FIG. 2) toward the rear end (lower side in FIG. 2) of the sleeve 100. That is, the shape of the outer circumferential surface of the insertion portion 120 is tapered from the front end toward the rear end of the sleeve 100.

The connector body 90 is to be inserted into the connector body insertion hole 100*h* of the sleeve 100. That is, the sleeve 100 is attached to the outer circumferential surface of the connector body 90. In this state, the insertion portion 120 is located in the rear end portion of the connector body 90.

Figure 3:
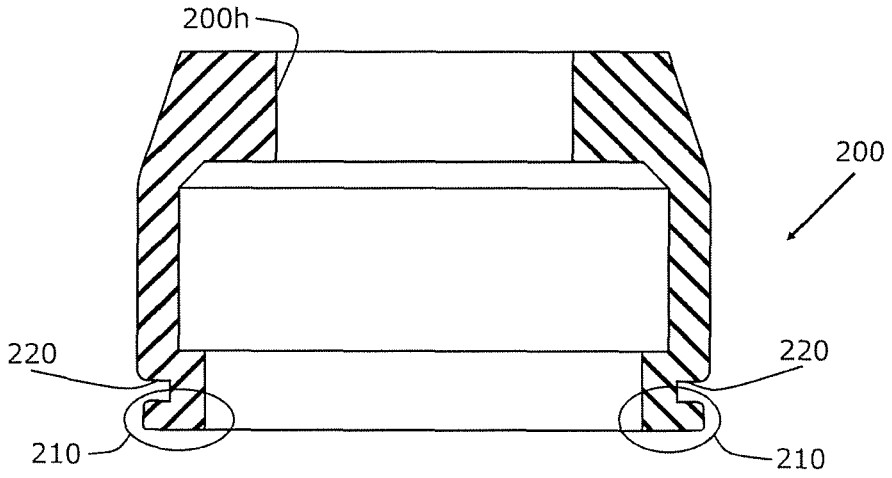
FIG. 3 is a cross-sectional view of an elastic member of the connector.

FIG. 3 is a cross-sectional view of the elastic member 200.

The elastic member 200 is composed of an elastic material. The elastic member 200 has a shape of a cylinder (a substantial cylinder). The elastic member 200 includes a connector body insertion hole 200*h*, a pressing portion 210, and a groove 220. The inner circumferential surface of the elastic member 200 is the connector body insertion hole 200*h*. The connector body 90 is to be inserted into the connector body insertion hole 200*h*. The pressing portion 210 is disposed in the proximity of one open end (rear end, lower side in FIG. 3) of open ends of the elastic member 200. The groove 220 is disposed in the rear end portion of the elastic member 200 in the proximity of the pressing portion 210 on the outer circumferential surface of the elastic member 200.

The connector body 90 is to be inserted into the connector body insertion hole 200*h*. That is, the elastic member 200 is attached to the outer circumferential surface of the connector body 90. In this state, the pressing portion 210 comes in contact with the portion to be pressed 110 of the sleeve 100. In other words, the elastic member 200 is attached to the front of the outer circumferential surface of the connector body 90. The sleeve 100 is attached to the rear of the elastic member 200 on the outer circumferential surface of the connector body 90 in a state the sleeve 100 is in contact with the elastic member 200. As described below, the elastic member 200 biases the sleeve 100 toward the rear end of the connector body 90 when the gooseneck microphone 1 is attached to the microphone stand 20.

Figure 4:
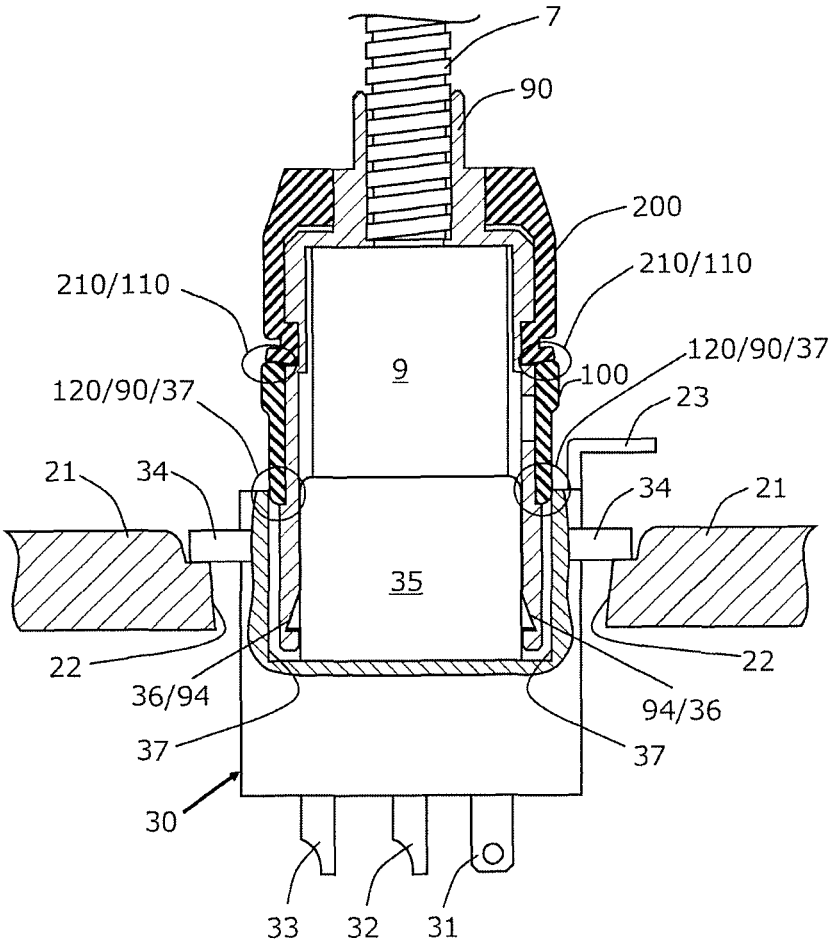
FIG. 4 is a partially sectional view of the connector portion of the microphone attached to a microphone stand.

FIG. 4 is a partially sectional view of the connector base 9 and the first output connector 30 of the gooseneck microphone 1 attached to the microphone stand 20.

The rear end of the connector body 90 is inserted into the connector support hole 37. The latch hole 94 of the connector body 90 engages with the latch claw 36 of the first output connector 30. At the same time, the insertion portion 120 of the sleeve 100 is inserted into the space between the connector body 90 and the connector support hole 37. In other words, the position where the sleeve 100 and the elastic member 200 are attached on the outer circumferential surface of the connector body 90 is the position where the insertion portion 120 of the sleeve 100 can be inserted into the space between the connector body 90 and the connector support hole 37 when the gooseneck microphone 1 is attached to the microphone stand 20.

FIG. 4 illustrates an example that the entire insertion portion 120 (see FIG. 2) of the sleeve 100, in other words, the entire tapered portion of the outer circumferential surface of the sleeve 100 is inserted into the space between the connector body 90 and the connector support hole 37. Alternatively, only a part of the tapered portion of the outer circumferential surface of the sleeve 100 may be inserted into the space between the connector body 90 and the connector support hole 37 in the present invention. That is, a part of or all of the tapered portion of the outer circumferential surface of the sleeve 100 may be inserted into the space between the connector body 90 and the connector support hole 37 in the present invention. In other words, in the present invention, the insertion portion of the sleeve is a part of the sleeve, and the portion is to be inserted into the space between the connector body and the connector support hole.

The gooseneck microphone 1 attached to the microphone stand 20 is fixed to the microphone stand 20 by the insertion portion 120 of the sleeve 100 inserted into the space between the connector body 90 and the connector support hole 37 in addition to the engagement between the latch claw 36 and the latch hole 94. Consequently, in the gooseneck microphone 1, loose connections to the microphone stand 20 are to be prevented as compared to the conventional gooseneck microphone 10 that is fixed only by the engagement between the latch claw 36 and the latch hole 94. Especially, when a part of the tapered portion of the outer circumferential surface of the sleeve 100, for example, only the tip portion of the rear end of the sleeve 100 is inserted into the space between the connector body 90 and the connector support hole 37, a so-called wedge effect is produced. That is, the tip portion of the sleeve 100 fills the space between the connector body 90 and the connector support hole 37. At the same time, the sleeve 100 receives pressure from the pressing portion 210. Thus, the tip portion of the sleeve 100 is pressed toward the connector support hole 37, and fixed within the space. As a result, effects which prevent the loose connection of the gooseneck microphone 1 to the microphone stand 20 are improved.

As described above, the outer circumferential surface of the insertion portion 120 is tapered from the front end to the rear end. Thus, the insertion portion 120 readily enters the space between the connector body 90 and the connector support hole 37 when the rear end of the connector body 90 is inserted into the connector support hole 37.

Furthermore, the elastic member 200 biases the sleeve 100 toward the rear end of the connector body 90. Thus, the insertion portion 120 that has been inserted into the space between the connector body 90 and the connector support hole 37 is biased toward the rear side (lower side in FIG. 4) of the connector support hole 37. In other words, the insertion portion 120 inserted into the space between the connector body 90 and the connector support hole 37 does not readily fall off from the space.

The sleeve 100 and the elastic member 200 may be composed of different materials. That is, for example, a modulus of elasticity (for example, Young's modulus) of the elastic member 200 may be higher than that of the sleeve 100, in other words, the elastic member 200 may be composed of the material that has higher resistance to deformation than that of the sleeve 100. In such a case, the displacement (displacement toward the front end of the outer circumferential surface of the connector body 90) of the pressing portion 210 can be prevented when the insertion portion 120 is inserted into the space between the connector body 90 and the connector support hole 37 with reaction force from the pressed portion 110 to the pressing portion 210. Further, even if the pressing portion 210 is deformed by the reaction force from the pressed portion 110, the displacement of the pressing portion 210 toward the front end of the outer circumferential surface of the connector body 90 is prevented by the groove 220 disposed in the proximity of the pressing portion 210. Consequently, the insertion portion 120 does not readily fall off from the space between the connector body 90 and the connector support hole 37 by the adjustment of the moduli of the elasticity between the elastic member 200 and the sleeve 100 and the effect of the groove 220. As a result, the loose connections of the gooseneck microphone 1 to the microphone stand 20 is prevented.

According to the embodiment described above, to the outer circumferential surface of the connector body 90 that is to be inserted into the connector support hole 37, the sleeve 100 that has the insertion portion 120 to be inserted into the space between the connector body 90 and the connector support hole 37, and the elastic member 200 that biases the insertion portion 120 of the sleeve 100 toward the connector support hole 37 are attached. Thus, a part (a space in the proximity of the upper surface of the first output connector 30) of the space between the connector body 90 and the connector support hole 37 is filled with the insertion portion 120.

Consequently, the gooseneck microphone 1 attached to the microphone stand 20 is fixed to the microphone stand 20 by the insertion portion 120 of the sleeve 100 inserted into the space between the connector body 90 and the connector support hole 37 in addition to the engagement between the latch claw 36 and the latch hole 94. Thus, the loose connections to the microphone stand 20 is prevented as compared to the conventional gooseneck microphone 10 that is fixed only by the engagement between the latch claw 36 and the latch hole 94. As a result, the gooseneck microphone 1 is prevented from outputting noise due to, for example, vibration of a desk on which the microphone stand 20 is placed.

The invention claimed is:

1. A connector for a microphone comprising:

pins to be electrically connected to a microphone stand;

a connector body accommodating the pins;

a sleeve disposed on an outer circumferential surface of the connector body; and an elastic member for biasing the sleeve toward the rear end of the connector body, wherein the sleeve has an insertion portion to be inserted into a space between the connector body and a connector support hole of the microphone stand, the elastic member has a pressing portion at its rear end that contacts a pressed portion of the sleeve, and the elastic member has a groove in its rear end such that, in response to a reaction force from the pressed portion of the sleeve on the pressing portion of the elastic member, the pressing portion of the elastic member is deformable and a displacement of the pressing portion of the elastic member toward a front end of the outer circumferential surface of the connector body is prevented.

2. The connector for the microphone according to claim 1, wherein the sleeve has a shape of a cylinder, the elastic member presses the front end of the sleeve, and the insertion portion is disposed at the rear end of the sleeve.

3. The connector for the microphone according to claim 2, wherein the outer diameter of the insertion portion gradually decreases from the front end toward the rear end of the sleeve.

4. The connector for the microphone according to claim 1, wherein the modulus of elasticity of the elastic member is higher than the modulus of elasticity of the sleeve.

5. The connector for the microphone according to claim 1, wherein the connector body has a latch hole that can be engaged with a latch claw disposed in the connector support hole, and the latch hole is disposed at a position closer to the rear end of the connector body than the position of the sleeve.

6. A microphone comprising:

a microphone unit;

a connector to be electrically connected to the microphone unit; and a connection member connecting the microphone unit with the connector, wherein the connector comprises pins to be electrically connected to a microphone stand, a connector body accommodating the pins, a sleeve disposed on an outer circumferential surface of the connector body, and an elastic member for biasing the sleeve toward the rear end of the connector body, wherein the sleeve has an insertion portion to be inserted into a space between the connector body and a connector support hole of the microphone stand.

7. The microphone according to claim 6, wherein the connection member includes a bendable flexible pipe.

* * * * *